US005816217A

United States Patent [19]

Wong

[11] Patent Number: 5,816,217

[45] Date of Patent: Oct. 6, 1998

[54] DIESEL ENGINE AIR/FUEL RATIO CONTROLLER FOR BLACK SMOKE REDUCTION

[76] Inventor: Ping Lun Wong, 6322 Rundlehorn Drive NE., Calgary, Alberta, Canada, T1Y 1M7

[21] Appl. No.: 819,656

[22] Filed: Mar. 17, 1997

[30] Foreign Application Priority Data

Nov. 25, 1996 [CN] China ..... 96237798.8

[51] Int. Cl.[6] ..... F02M 37/04

[52] U.S. Cl. ..... 123/382; 123/389

[58] Field of Search ..... 123/382, 389, 123/372, 370

[56] References Cited

U.S. PATENT DOCUMENTS

| | | | |
|---|---|---|---|
| 2,183,035 | 12/1939 | Weber | 123/382 |
| 2,633,115 | 3/1953 | Waring | 123/382 |
| 2,698,614 | 1/1955 | Nicolls | 123/382 |
| 2,891,533 | 6/1959 | Glegg | 123/382 |
| 3,650,257 | 3/1972 | Soltau | 123/382 |
| 3,722,487 | 3/1973 | Ohama | 123/382 |
| 4,095,573 | 6/1978 | Kollmann | 123/382 |
| 4,159,753 | 7/1979 | Boche | 123/382 |

FOREIGN PATENT DOCUMENTS

| | | | |
|---|---|---|---|
| 141774 | 5/1935 | Austria | 123/382 |
| 144263 | 1/1936 | Austria | 123/382 |
| 559592 | 7/1958 | Canada | 123/382 |
| 958580 | 11/1957 | France | 123/382 |

*Primary Examiner*—Carl S. Miller
*Attorney, Agent, or Firm*—Thomas E. Malyszko

[57] ABSTRACT

A controller for mechanically setting a diesel engine's air/fuel ratio at a stoichiometric value to reduce black smoke emissions by regulating the quantity of fuel injected into a diesel engine's combustion chamber in response to the quantity of air flow to the engine's cylinder consists of an air flow sensor device and a modulator. The air flow sensor device has a venturi tube located along the engine's air intake conduit, and the modulator is in air communication with the venturi tube via a hollow hose. The modulator is located between a fuel control device, such as an automobile's accelerator pedal, and the engine's fuel injection pump. The modulator consists of an outer shell, internal diaphragm, return spring, push-pull rod and air valve system. The diaphragm divides the modulator's interior cavity into a front chamber and a rear chamber which communicates with the venturi tube. The return spring is located in the rear chamber and urges the diaphragm forwardly so as to expand or enlarge the rear chamber and to contract or diminish the size of the front chamber. One end of the push-pull rod, which is generally axially aligned with the return spring, passes through the front of the modulator's outer shell and connects to the diaphragm; and, the other end of the push-pull rod is operatively connected to control levers for the fuel injector and the accelerator pedal. The air valve system is located between the rear chamber and the outer shell of the front chamber, and is operatively connected to the control levers. The air valve system includes a front valve seat, rear valve seat and an air duct which provides air communication between the ambient and the front and rear chambers.

15 Claims, 6 Drawing Sheets

IDLING POSITION

ACCELERATING POSITION

HOLDING POSITION 4.0 Rb

BEFORE 1.4 Rb

AFTER

The Comparison of black smoke in a Diesel engine

| Working Condition / Black smoke / Controller | Idling | Slow Acceleration | Fast Acceleration | Sudden Acceleration |
|---|---|---|---|---|
| Not installed | No | No | Yes | Heavy |
| Installed | No | No | No | No |

Fig. 8

Road Test Result Comparison

| Working Condition / Black smoke / Controller | Start moving in first gear | First gear accele-ration | Second gear accele-ration | Third gear accele-ration | Fourth geaar accele-ration | Uphill |
|---|---|---|---|---|---|---|
| Not installed | Yes | No | Light | Yes | Heavy | Yes |
| Installed | No | No | No | No | No | No |

Fig. 9

DIESEL ENGINE AIR/FUEL RATIO CONTROLLER FOR BLACK SMOKE REDUCTION

FIELD OF THE INVENTION

The present invention relates to a system and method for reducing undesireable engine exhaust emissions, such as the amount of black smoke produced by diesel engines, and for increasing engine fuel consumption efficiency, and in particular to an apparatus for controlling an engine's air/fuel ratio.

BACKGROUND OF THE INVENTION

Diesel engines are widely used in transpiration, construction and farming equipment due to their relative efficiency, reliability and economical operating costs, but unfortunately they continue to emit clouds of black smoke. Such black smoke is formed by solid particles of carbon soot which results from incompletely burned diesel fuel due to an inadequate or incorrect air/fuel ratio, particularly when a diesel engine is accelerated. Although about 30% of such particulate diesel engine emissions are heavy enough to settle out of the air, the remaining 70% or so can cause health hazards by continuing to float in the air for extended periods.

Some current attempts to solve such undesireable emissions target the exhaust emissions directly, typically by providing catalytic converter systems or filtering devices. A disadvantage of filtering systems is that they require frequent cleaning or replacement to avoid clogging and reducing exhaust pressures which deteriorate engine operation and increase fuel consumption. Catalytic converters are expensive to install and do not solve the carbon particle problem.

Other proposed solutions target the air/fuel ratio to the engine. Prior art air/fuel regulation systems typically gauge the amount of fuel entering the engine, and then adjust the volume of air flow in a predetermined manner. Unfortunately, these systems are generally expensive and complex, requiring micro-processors and other electro-mechanical components which are relatively delicate and susceptible to malfunctions.

What is desired therefore is a controller for reducing black smoke emissions and increasing fuel efficiency which overcomes the disadvantages of the prior art devices. Preferably it should adjust the amount of fuel injected into an engine's combustion chamber in accordance with the quantity of air intake to provide a desired air/fuel ratio where the fuel should be burned completely. The controller should be a durable mechanical device without electrical components to minimize production costs as well as maintenance costs after installation. It should be designed for use with both throttled and unthrottled diesel engines, and should be capable of easy installation with minimal alteration to new or used engines.

SUMMARY OF THE INVENTION

The present invention controls the air/fuel ratio at or about an optimum or stoichiometric value by regulating the quantity of fuel injected into a diesel engine's combustion chamber in response to the quantity of air flow to the combustion chamber.

The invention consists of an air flow sensor device and a modulator. The air flow sensor device has a venturi tube located along the engine's air intake conduit near its intake manifold, and the modulator is in air communication with the venturi tube via a hollow hose or pipe. The modulator is located between a fuel control device, such as an automobile's accelerator pedal, and the engine's fuel injection pump. The modulator consists of an outer shell, internal diaphragm, return spring, push-pull rod and air valve system. The diaphragm divides the modulator's interior cavity into a front chamber and a rear chamber which communicates with the venturi tube. The return spring is located in the rear chamber and urges the diaphragm forwardly so as to expand or enlarge the rear chamber and to contract or diminish the size of the front chamber. One end of the return spring rests at the back of the rear chamber, and the other end presses against the center of the diaphragm. One end of the push-pull rod, which is generally axially aligned with the return spring, passes through the front of the modulator's outer shell and connects to the diaphragm; and, the other end of the push-pull rod is operatively connected to control levers for the fuel injector and the accelerator pedal. The air valve system is located between the rear chamber and the outer shell of the front chamber, and is operatively connected to the control levers. The air valve system includes a front valve seat, rear valve seat and an air duct. The air duct provides air communication between the ambient and the front and rear chambers.

When the rear valve seat is closed (ie. air communication through the seat is prevented) and the front valve seat is opened, the front chamber is consequently opened to the ambient and air communication between the front and rear chambers is stopped. Hence, any air pressure differentials between the chambers will move the diaphragm and the push-pull rod, resulting in a fuel flow adjustment to the engine. For instance, as air flow through the venturi tube to the engine increases, the air pressure in the rear chamber will drop, causing the diaphragm and push-pull rod to be pulled rearwardly, thus increasing fuel flow to the engine. Alternately, when the rear valve seat is opened and the front valve seat is closed, air pressure is allowed to equalize between the chambers and the diaphragm to move to a position consistent with engine idling. When both front and rear seats are opened, the diaphragm is urged into an equilibrium position, which occurs when the engine is in a "holding" mode (namely, after the engine has been accelerated and is kept at constant RPM).

In a preferred aspect the present invention provides a controller for adjusting the air/fuel ratio to an engine comprising:

a device for intercepting at least some air flow entering said engine and for creating a negative pressure proportional to the quantity of said air flow in a pipe means communicating with said intercepting device; and a modulator operatively connected to a fuel injector for said engine and in air communication with said intercepting device through said pipe means, wherein said modulator mechanically translates said negative pressure communicated through said pipe means into displacements of said fuel injector for adjusting the quantity of fuel being supplied to said engine to substantially maintain an optimum fuel ratio with said air flow for reducing black smoke emissions from said engine.

In another aspect the invention provides an improved method of controlling the air/fuel ratio to an engine in which the improvement comprises adjusting the fuel flow to said engine in accordance with the quantity of air flow into said engine with the aid of the above controller.

DESCRIPTION OF THE DRAWINGS

Embodiments of the invention will now be described, by way of example only, with reference to the accompanying drawings, wherein.

DESCRIPTION OF PREFERRED EMBODIMENTS

Figure 1:
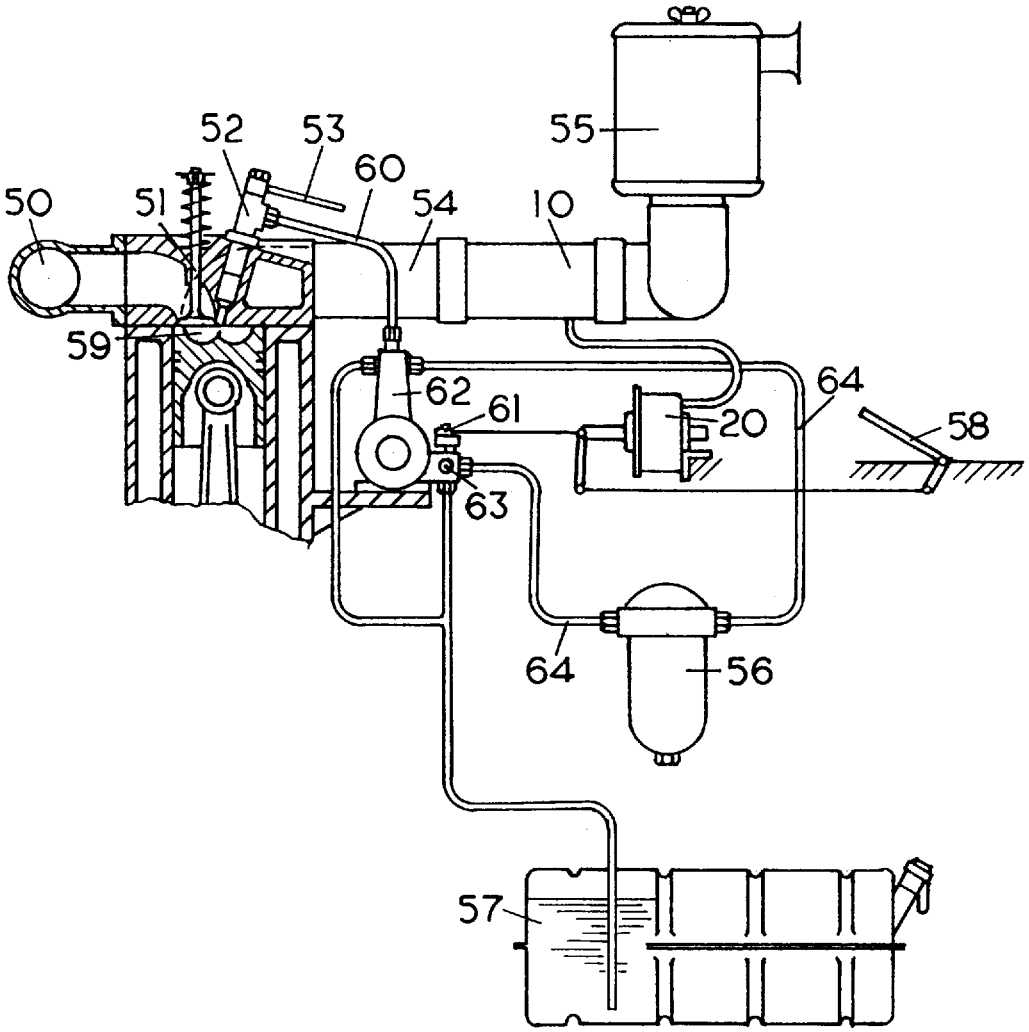
FIG. 1 illustrates an air/fuel ratio controller according to the present invention mounted on a diesel engine.

Reference is first made to FIG. 1 which shows a controller of the present invention mounted to a typical automobile diesel engine. An automobile engine is chosen for illustrative purposes as the controller may be used with various types of diesel engines. The depicted features of the engine include an exhaust pipe 50, exhaust valve 51, injection nozzle 52, return pipe 53, intake manifold 54, air filter 55, fuel tank 57, accelerator pedal 58, combustion chamber 59, high pressure piping 60, injection pump (high pressure) 62, control lever 61 for the injection pump, fuel pump (low pressure) 63, and low pressure piping 64.

Figure 2:
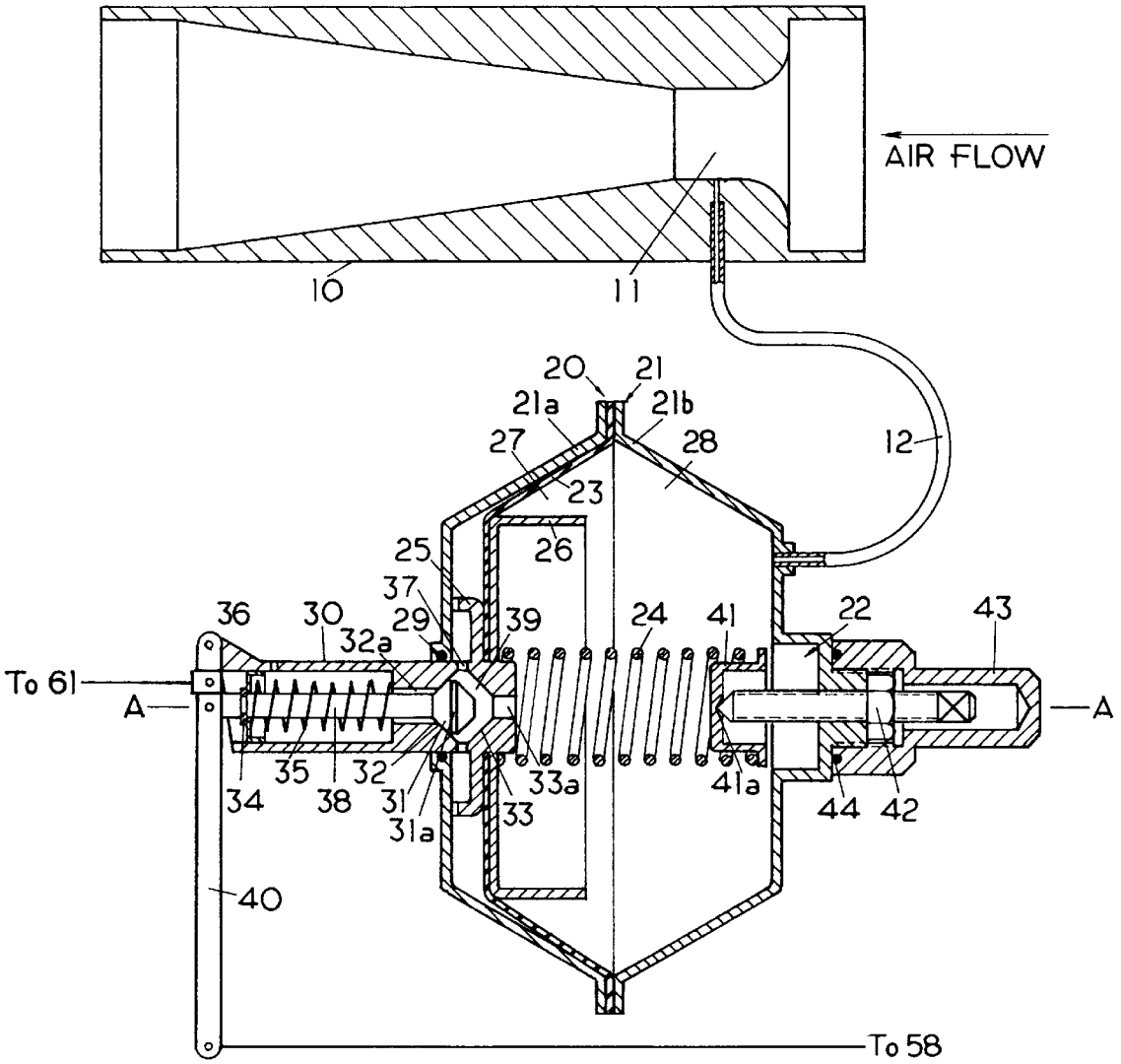
FIG. 2 is a close-up internal view of the controller of FIG. 1.

Referring now to FIG. 2 which shows in greater detail a preferred embodiment of the controller which has an air flow sensor apparatus 10 in air communication with a modulator 29. The air flow sensor 10 is mounted between the engine's air filter 55 and intake manifold 54. A flexible hollow hose or tube 12 leads from the neck of the sensor 10 to the modulator 20. The sensor houses a venturi tube 11 for intercepting some or all of the air flow and creates a negative pressure in the hose 12 proportional to the quantity of the air flow to the intake manifold.

The modulator 20 has an outer shell 21, preferably made of a metal or other suitably rigid material, formed by two joined pieces, namely a first or front shell 21*a* and a second or rear shell 21*b*. The hollow pipe 12 connects to the rear shell 21*b*. A diaphragm 23 made of rubber or other suitably flexible material is fitted between the front and rear shells 21*a*, 21*b*. The diaphragm 23 divides the modulator's hollow interior cavity into first and second chambers 27 and 28, respectively. For ease of reference, the first and second chambers 27, 28 will be referred to as the front and rear chambers, respectively. A part of the diaphragm is supported by a flanged rear disk 26, and a portion of the supported diaphragm is sandwiched between the rear disk 26 and a smaller diameter front disk 25 in an air tight manner. The support disks 25, 26 help maintain the shape of the diaphragm and ensure that the diaphragm can efficiently and accurately slide a push-pull rod 30 in and out of the modulator along an axis "A" without tearing or damaging the diaphragm. A return spring 24 is disposed inside the rear chamber 28. One end (ie. the "rear" end) of the spring 24 extends toward a spring seat 22 located at about the center of the interior surface of the rear shell 21*b*. The other (ie. "front") end of the spring 24 presses against the center of the rear support disk 26 directly opposite the push-pull rod 30 and in axial alignment therewith along axis "A". The push-pull rod 30 extends through and slidingly engages an opening 29 in the center of the front outer shell 21*a*. An air tight seal is maintained between the push-pull rod and opening to prevent air escape from the front chamber 27. A rear end of the rod 30 is attached to the diaphragm 23 by the front and rear support disks 25, 25. If desired, one or both of these disks may be formed integrally 25 with the rod 30, as depicted.

An air valve system is located within and partially formed by a generally cylindrical hollow interior of the rod 30 which is open to the ambient through one or more air passage openings 36. The air valve system includes a front valve seat 32, a rear valve seat 33 located at the rear end of the rod 30 opposite the front valve seat 32, an elongate valve stem 38, and a double cone shaped valve core element 31 fixed to the rear end of the stem 38 which extends through the front valve seat 32. The core element 31, located within a valve chamber or bore 39 formed between the front and rear valve seats 32 & 33, is adapted to sealingly engage the front and rear valve seats 32, 33. A ring 31 *a* of resilient material may be added to enhance sealing contact with the seats. The valve bore 39 communicates: with the modulator's front chamber 27 through one or more lateral air passage hole 37 in the rod 30 (as viewed in FIG. 2); with the rear chamber 28 through a rearward air passage hole 33*a* formed by the rear valve seat 33; and, with the ambient through a front air passage hole 32*a* formed by the front valve seat 32. Consequently, the modulator's front chamber 27 may communicate with the ambient through a passage formed by lateral holes 37, valve bore 39, rear hole 33*a* and opening 36. Likewise, the front and rear chambers 27, 28 may communicate therebetween via a combination of lateral holes 37, valve bore 39 and hole 33*a* in the rear valve seat 33.

A control lever 40 operatively connected to accelerator 58 is pivotally connected to the front end of the valve stem 38 and to a remote end of the push-pull rod 30 as shown. The accelerator lever 40 is likewise operatively connected to the fuel injection pump 62 by control lever 61. Therefore, the accelerator operates both the fuel injection lever 61 and the valve stem 38, as described below. A valve spring 35 placed about the valve stem 38 engages a spring retainer 34 mounted on the stem 38 and urges the valve stem into sealing engagement with the front valve seat 32 (ie. to the left in FIG. 2).

In the preferred embodiment, the spring seat 22 is adapted to provide a means for adjusting the compression of return spring 24. The seat 22 is aligned with longitudinal axis "A" and has a tubular, top hat shaped element 41 capping the end of the return spring, an adjustment screw 42, and a cover 43 for sealingly engaging the seat 22 with the aid of a ring seal 44. The forward tip of the screw 42 is cone shaped and adapted to engage a correspondingly shaped depression at 41*a* on an inside surface of the cap element 41 to provide positive engagement between the screw and cap and ensure that they remain aligned as shown. By adjusting the screw 42 to and fro, the compression of the return spring 24 may be adjusted to an optimum level or setting, as discussed below.

Figure 3A:
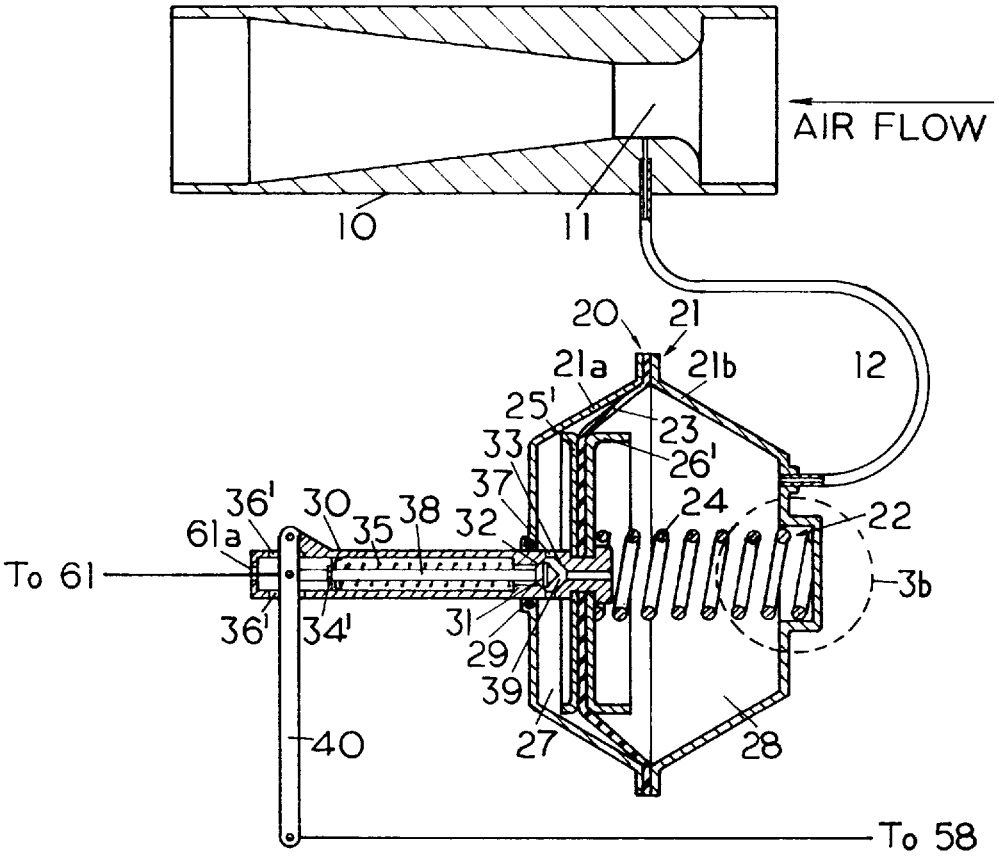
FIG. 3*a* shows a controller according to another embodiment of the present invention.
Figure 3B:
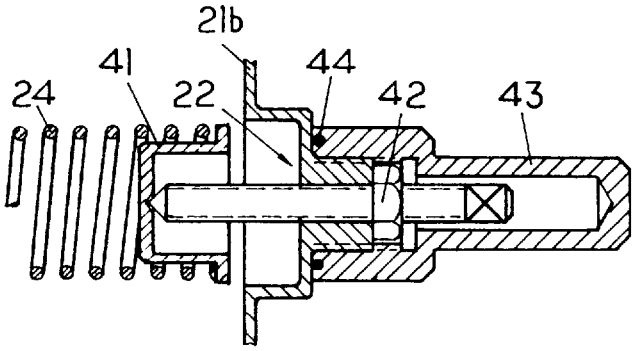
FIG. 3*b* is a detailed view of the circled portion of the controller of FIG. 3*a*.

Referring now to FIGS. 3*a* and 3*b* where similar reference numbers designate like parts in an alternate embodiment of the present invention, the controller is in essence identical to the controller of FIG. 2 except that the front support disk 25[1]

of FIG. 3*a* is larger than the disk 25 of FIG. 2, namely it corresponds in size to the rear support disk 26[1]. The casing of the push-pull rod 30 has also been extended forwardly to encompass the control levers 40 and 61, and the openings 36[1] at the front end of the push-pull rod 30 have been re-arranged so that the accelerator control lever 40 passes through the openings as shown in FIG. 3*a*. The pump control lever 61 extends into the rod 30 trough an aperture 61*a* at the tip of the rod and connects to the accelerator lever 40. The spring retainer 34[1] is air permeable to allow air communication between the chambers 27, 28 and the ambient.

The operation of the present invention, as well as its many advantages and benefits, may now be better appreciated. Referring to FIGS. 1 & 2 again, the controller is installed onto the diesel engine by: mounting the air flow sensor 10 between the air filter 55 and the intake manifold 54; connecting the modulator's push-pull rod 30 to the accelerator control lever 40, and the lever 40 to the injection pump control lever 61; and connecting the flexible hose 12 between the air flow sensor 10 and the modulator 20. When the diesel engine is operating, air is sucked into the intake manifold 54 through the venturi tube 11 where it creates a suction or negative pressure in the hose 12 proportional to the quantity of air passing through the venturi. Hence, a negative pressure or suction is created in the modulator's rear chamber 28 via pipe 12.

Figure 4:
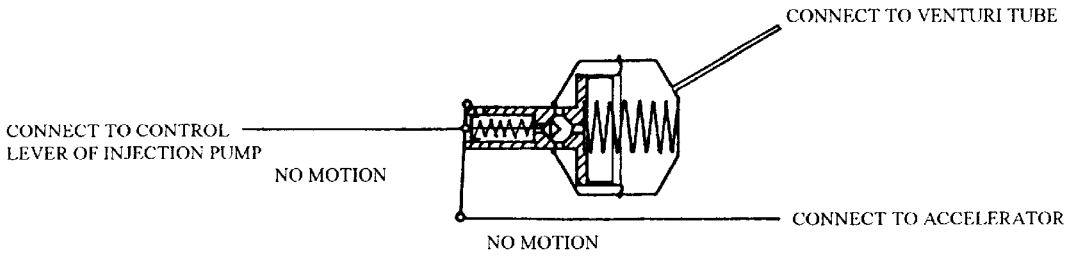
FIG. 4 shows an idling position of the controller.
Figure 5:
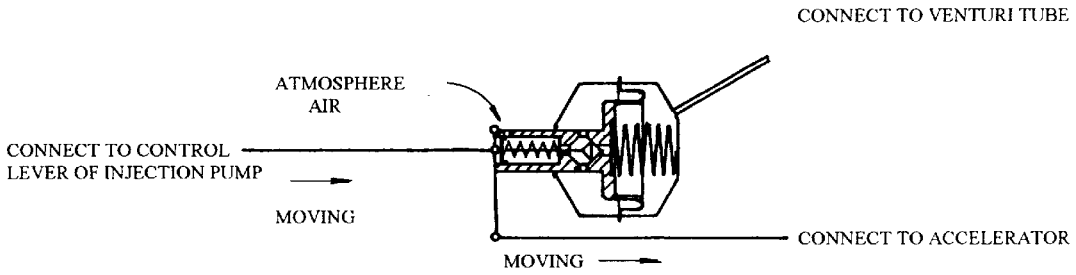
FIG. 5 shows an accelerating position of the controller.
Figure 6:
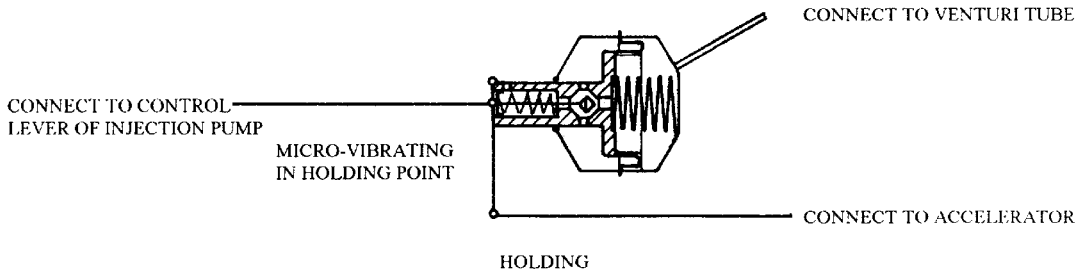
FIG. 6 shows a holding (constant velocity) position of the controller.

Referring now as well to FIGS. 4–6 which show the modulator in various operating positions, when the accelerator is in a released or idling position (FIG. 4) the valve core 31 is urged forwardly by the valve spring 31 into contact with the front valve seat 32 to block or close the valve hole 32*a* and prevent air flow therethrough, and opens the hole 33*a* in the rear valve seat 33 to allow for air communication between the front and rear chambers 27 and 28. With the engine operating and creating a suction in the rear chamber 28, negative pressure is also created in the front chamber 27 through holes 33*a* and 37. Although the diaphragm 23 does not move because the negative pressures on both sides should be equal or balanced, the modulator is now prepared to send a set amount of fuel for injection into the engine's combustion chamber in proportion to the volume of air flow through the venturi upon further operation of the engine as described next.

When the accelerator is depressed (FIG. 5), the control lever 40 pushes the valve core 31 backward into contact with the rear valve seat 33 to close the rear valve hole 33*a*, and moves away from the front valve seat 32 to open up hole 32*a*. Hence, the front chamber 27 is opened to the ambient pressure. Since the front chamber is under a negative pressure, air rushes into the front chamber to return it to the higher ambient pressure, and so a pressure differential or imbalance is created between the front chamber 27 and the rear chamber 28 which remains under a lower (ie. negative) pressure. The diaphragm 23 is therefore pushed rearwardly (ie. to the right in FIG. 5), pulling the push-pull rod 30 and the injection pump control lever 61 along with it until an equilibrium point is reached. The distance traveled by the diaphragm and rod depends on the initial pressure difference between the chambers 27 & 28, which pressure difference is proportional to the quantity of air flow through the venturi tube 11. Movement of the lever 61 injects an additional amount of fuel into the engine. As a result, the modulator is able to adjust the quantity of fuel reaching the engine in accordance with the quantity of air flow into the engine. By adjusting the compression of the return spring 24 using the spring seat 22, a user is able to adjust the movement of the diaphragm and rod in an effort to bring the air and fuel entering the combustion chamber 59 as close as possible to the stoichiometeric air/fuel ratio.

As more fuel is injected into the combustion chamber, the engine's venturi tube increases, which sucks more air into the engine past the venturi. The increased air flow causes more suction and a resulting increase in the negative pressure in the modulator's rear chamber. Hence, the diaphragm is moved further to the rear, causing more fuel to be injected into the combustion chamber. When the accelerator is pressed continually, the volume of injected fuel will increase in direct proportion to the volume of air flow through the intake manifold. At some point the accelerator will be eased back and held in a driving (ie. constant velocity) position and the diaphragm will reach an equilibrium position in accordance with the amount of air flow passing the venturi into the engine (see FIG. 6). In this situation, the valve core 31 maintains its position relative to the push-pull rod 30. However, the diaphragm repeatedly moves or oscillates slightly to and fro according to the amount of air flow into the engine (i.e. it is in a state of motion equilibrium). During such movement, when the diaphragm moves backward, the rear valve seat 33 is opened up and the pressure differential between the front and rear chambers disappears. As a result, the diaphragm moves forward so that the rear valve seat 33 engages the valve core 31, therefore allowing a pressure differential to build up again between the two chambers. During such "micro" oscillations of the diaphragm and push-pull rod, the injection pump control lever 61 remains relatively stable or immobile, thus in effect maintaining a constant engine running speed. The "micro" oscillations are so small that they do not create appreciable fluctuations in the engine r.p.m.

When the accelerator is released, the rearward force on the valve core 31 disappears, and so the valve core is pulled forward by the valve spring 35 to its resting position, namely into contact with the front valve seat 32. Hence, the rear valve hole 33*a* is opened and the front valve hole 32*a* is closed to dissipate the pressure difference between the front and rear chambers 27, 28. The diaphragm and push-pull rod 30 are pushed back to their resting position (FIG. 4) by return spring 24. The modulator therefore stops its action and the diesel engine returns to its idling position.

An advantage of the present controller is that it allows a user to actively control the engine with the accelerator (ie. to maintain the accelerator at any position), yet at the same time it automatically makes small adjustments to the fuel being injected into the combustion chamber according to the air flow to the engine to ensure an optimum air/fuel ratio at all stages of the diesel engine's operation. An optimum air/fuel ratio promotes complete burning of injected fuel, resulting in improved fuel efficiency and reduced generation of carbon particles and black smoke.

Figures 7A, 7B:
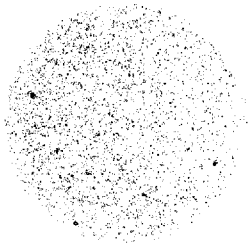
FIG. 7*a* illustrates the quantity of black smoke emission from an automobile's diesel engine without the controller of the present invention.
FIG. 7*b* illustrates the quantity of black smoke emission from an automobile's diesel engine with the controller installed; and, FIGS. 8 and 9 show tables comparing test result of black smoke emissions from diesel engines with and without the controller installed.

The above device has been installed and tested on a light-truck, class TC 1030CS, 3240 kg (7128 lb) weight, and 1250 kg (2750 lb) capacity. The test results, compiled and illustrated in FIGS. 7*a*, 7*b*, 8 and 9, show a significant reduction in black smoke emissions. FIGS. 7*a* and 7*b* illustrate the results of a FBY-1 black smoke meter test, using a GB 3846-83 standard test method. The result in FIG. 7*a* shows a black smoke emission value of 4.0 Rb before installing the above controller, whereas the result in FIG. 7*b* shows a black smoke emission value of 1.4 Rb after installing the controller, namely a 65% reduction. FIGS. 8 and 9 further illustrate the device's ability to reduce black smoke emissions at various stages of the truck engine's operation. The overall test results illustrate that the device is able to reduce black smoke emissions significantly.

Another advantages of the present controller is its "universal" applicability, namely it may be adapted for both throttled and unthrottled engines, and can be used for both new engines (ie. built-in) and used engines (ie. retrofitted). The device operates as an automatic feedback system, and so may be used in any operating conditions, particularly those which always fluctuate, such as in automobiles. The device is easy to install at minimum cost since an engine design or layout need not be altered. The controller is "trouble free" in that it is a mechanical device made of durable materials such as metals or the like without any relatively delicate electrical or microprocessor-type components. Thus, very little maintenance is required post installation. In addition, manufacturing costs for the device are very low, and so it is more economical to produce than other existing systems for controlling air/fuel ratios.

The above description is intended in an illustrative rather than a restrictive sense and variations to the specific configurations described may be apparent to skilled persons in adapting the present invention to specific applications. Such variations are intended to form part of the present invention insofar as they are within the spirit and scope of the claims below.

I claim:

1. A controller for adjusting the air/fuel ratio to an engine having a fuel injector and an accelerator operatively connected thereto, said controller comprising:

a device for intercepting at least some air flow entering said engine and for creating a negative pressure proportional to the quantity of said air flow in a pipe means communicating with said intercepting device; and a modulator operatively connected to said fuel injector and in air communication with said intercepting device through said pipe means, wherein said modulator mechanically translates said negative pressure communicated through said pipe means into displacements of said fuel injector for adjusting the quantity of fuel being supplied to said engine to substantially maintain an optimum fuel ratio with said air flow for reducing black smoke emissions from said engine, said modulator comprising:

an outer shell forming an interior cavity;

a flexible diaphragm for dividing said interior cavity into a front chamber and a rear chamber, wherein said rear chamber communicates with said pipe means from said a first biaser disposed within said interior cavity for urging said diaphragm toward said front chamber to expand the rear chamber and contract the front chamber; and, an elongate push-pull rod having a rear portion connected to said diaphragm and extending through said front chamber and outer shell, and an opposed front portion located outside said outer shell and operatively connected to a lever for said accelerator and a lever for said fuel injector, said push-pull rod having a hollow interior for accommodating an air valve system which provides for selective air communication between said rear chamber, front chamber and the ambient;

wherein air pressure differentials between said front and rear chambers displace said diaphragm which displacement slides said push-pull rod relative to said outer shell and moves said fuel injector lever to adjust fuel flow to the engine.

2. The controller of claim 1 wherein said air valve system includes a valve core element operatively connected to said accelerator lever and movable relative to said push-pull rod between:

an idling position wherein air communication is open between said front and rear chambers, and is closed from the ambient to said front and rear chambers;

an accelerating position wherein air communication is open between said front chamber and the ambient, and is closed from the rear chamber to the front chamber and the ambient; and a holding position wherein air communication is intermittently open between the ambient, the front chamber and the rear chamber.

3. The controller of claim 2 wherein said air valve system further comprises:

an opening in said push-pull rod for air communication between the ambient and a front part of said hollow interior;

a valve bore formed at a rear part of the hollow interior for housing said valve core element, and having a front hole for air communication with said front part of the hollow interior;

a rear hole in said push-pull rod for air communication between said valve bore and said rear chamber; and, at least one lateral hole in said push-pull rod for air communication between said valve bore and said front chamber;

wherein said valve core element sealingly engages said front hole in said idling position and said rear hole in said accelerating position, and intermittently disengages said front and rear holes simultaneously in said holding position.

4. The controller of claim 3 wherein said air valve system further comprises an elongate valve stem extending through said front hole of the valve bore and having one end fixed to said valve core element and the other end connected to a lever for said accelerator, and a second biaser for urging said valve core into sealing engagement with said front hole.

5. The controller of claim 4 wherein said second biaser comprises a valve spring element located about said valve stem having one end abutting a lip adjacent said front hole and the other end abutting a spring retainer element fitted to the valve stem away from said lip.

6. The controller of claim 1 wherein a part of said diaphragm is supported by at least one disk carried by said rear portion of the push-pull rod.

7. The controller of claim 1 wherein said first biaser comprises a return spring axially aligned with said push-pull rod having one end abutting said rear portion of the push-pull rod and the other end located in a spring seat at the outer shell of said controller.

8. The controller of claim 7 wherein said spring seat includes a means of adjusting compression of said return spring element to an optimum level for a given engine to reduce said black smoke emissions.

9. The controller of claim 8 wherein said spring seat comprises a cap for capping said end of the spring element located in the spring seat, an adjustment screw engaging said cap and accessible to a user for adjusting the compression of said return spring by moving said cap relative to the said push-pull rod, and a cover for substantially isolating said adjustment screw from the ambient.

10. A control assembly for adjusting the air/fuel ratio to a diesel engine having a fuel injector and a user controlled accelerator therefor, said control assembly comprising:

an air flow sensor apparatus having a venturi device for intercepting at least some air flow entering said diesel engine and a pipe element communicating with said venturi device, said venturi device creating a negative pressure in said pipe element proportional to the quantity of said air flow; and a modulator operatively connected to said fuel injector and in air communication with said air flow sensor apparatus through said pipe element, said modulator mechanically translating said negative pressure communicated through said pipe element into displacements of said fuel injector to adjust the quantity of fuel being supplied to said diesel engine for substantially maintaining an optimum fuel ratio with said air flow to reduce black smoke emissions from said diesel engine.

11. The control assembly of claim 10 wherein said modulator comprises:

an outer shell forming an interior cavity;

a flexible diaphragm for dividing said interior cavity into a front chamber and a rear chamber, wherein said rear chamber communicates with said pipe element from said air flow sensor;

a first biaser disposed within said interior cavity for urging said diaphragm toward said front chamber to expand the rear chamber and contract the front chamber; and an elongate push-pull rod having a rear portion connected to said diaphragm and extending through said front chamber and outer shell, and an opposed front portion located outside said outer shell and operatively connected to a lever for said accelerator and a lever for said fuel injector;

wherein air pressure differentials between said front and rear chambers displace said diaphragm, which displacement slides said push-pull rod relative to said outer shell and moves said fuel injector lever to adjust fuel flow to the diesel engine.

12. The control assembly of claim 11 wherein said push-pull rod has a hollow interior for accommodating an air valve system which provides for selective air communication between said rear chamber, front chamber and the ambient.

13. The control assembly of claim 11 wherein said first biaser comprises a return spring axially aligned with said push-pull rod having one end abutting said rear portion of the push-pull rod and the other end located in a spring seat at the outer shell of said controller.

14. An improved method of controlling the air/fuel ratio to a diesel engine in which the improvement comprises adjusting the fuel flow to said diesel engine in accordance with the quantity of air flow into said engine with the aid of a control assembly comprising:

a device for intercepting at least some air flow entering said diesel engine and for creating a negative pressure proportional to the quantity of said air flow in a pipe means communicating with said intercepting device; and a modulator operatively connected to a fuel injector for said diesel engine and in air communication with said intercepting device through said pipe means, wherein said modulator mechanically translates said negative pressure communicated through said pipe means into displacements of said fuel injector for adjusting the quantity of fuel being supplied to said engine to substantially maintain an optimum fuel ratio with said air flow for reducing black smoke emissions from said diesel engine, said modulator comprising:

an outer shell forming an interior cavity;

a flexible diaphragm for dividing said interior cavity into a front chamber and a rear chamber, wherein said rear chamber communicates with said pipe means from said p2 a first biaser disposed within said interior cavity for urging said diaphragm toward said front chamber to expand the rear chamber and contract the front chamber; and, an elongate push-pull rod having a rear portion connected to said diaphragm and extending through said front chamber and outer shell, and an opposed front portion located outside said outer shell and operatively connected to a lever for said accelerator and a lever for said fuel injector, said push-pull rod having a hollow interior for accommodating an air valve system which provides for selective air communication between said rear chamber, front chamber and the ambient;

wherein air pressure differentials between said front and rear chambers displace said diaphragm, which displacement slides said push-pull rod relative to said outer shell and moves said fuel injector lever to adjust fuel flow to the engine.

15. The method of claim 14 comprising avoiding adjustment of said fuel flow when said diesel engine is idling and at constant velocity, and adjusting fuel flow when said diesel engine is accelerating.

* * * * *